United States Patent [19]

Benelli

[11] Patent Number: 4,604,942

[45] Date of Patent: Aug. 12, 1986

[54] BOLT ASSEMBLY WITH A ROTATING LOCKING BOLT HEAD AND A FLOATING BOLT ELEMENT FOR AUTOMATIC FIREARMS

[75] Inventor: Paolo Benelli, Pesaro, Italy

[73] Assignee: Benelli Armi S.p.A., Urbino, Italy

[21] Appl. No.: 602,219

[22] Filed: Apr. 19, 1984

[30] Foreign Application Priority Data

May 9, 1983 [IT] Italy ..... 44019 A/83

[51] Int. Cl.[4] ..... F41D 3/06

[52] U.S. Cl. ..... 89/185; 89/166; 89/172; 89/183

[58] Field of Search ..... 89/185, 183, 182, 166, 89/172

[56] References Cited

U.S. PATENT DOCUMENTS

| | | | |
|---|---|---|---|
| 2,476,232 | 7/1949 | Williams | 89/182 |
| 3,110,222 | 11/1963 | Harvey | 89/128 X |
| 3,969,983 | 7/1976 | Zellweger et al. | 89/185 |
| 4,191,089 | 3/1980 | Zedrosser | 89/185 X |
| 4,389,919 | 6/1983 | Kast et al. | 89/185 |
| 4,398,448 | 8/1983 | La Fever | 89/185 |

FOREIGN PATENT DOCUMENTS

| | | | |
|---|---|---|---|
| 1244620 | 7/1967 | Fed. Rep. of Germany | 89/185 |
| 1362363 | 4/1964 | France | 89/185 |
| 213930 | 3/1941 | Switzerland | 89/172 |
| 2091391 | 7/1982 | United Kingdom | 89/185 |

*Primary Examiner*—David H. Brown

*Attorney, Agent, or Firm*—Amster, Rothstein & Ebenstein

[57] ABSTRACT

A bolt assembly for an automatic firearm which operates using kinetic recoil energy that includes a floating bolt element, a rotatable locking bolt head and a return spring interposed between them, all in communication with the barrel. The bolt head is formed with a cylindrical portion having two crescent shaped projections located at diametrically opposite points along the circumference of the cylindrical portion. The barrel is formed with two diametrically opposite recesses associated with and shaped to correspond to the projections. The barrel is also formed with a pair of grooves, each groove associated with a recess such that the projections may enter and exit the grooves through the recesses. The grooves are staggered with respect to the recesses and have an angular extension such that the projections may enter and be retained within the grooves. The barrel is additionally formed with projecting edge guide grooves and the bolt element is formed with projecting edges that are guided by the projecting edge guide grooves. The bolt head is also formed with a shank and a cavity is formed in the bolt element for receiving the shank. The shank carries a pin that is adapted to impart a rotary movement to the bolt head by engaging a helical slot formed in the bolt element. Upon firing, the return spring is compressed which momentarily keeps the bolt head in a locked position which causes a delay to allow for the dissipation of pressures in the barrel.

2 Claims, 9 Drawing Figures

BOLT ASSEMBLY WITH A ROTATING LOCKING BOLT HEAD AND A FLOATING BOLT ELEMENT FOR AUTOMATIC FIREARMS

The present invention relates to an improvement in bolt assemblies for automatic firearms of the type with a locking bolt head and a floating bolt element with a spring interposed between them as disclosed in the Italian Pat. No. 762.319. The operation of these bolt assemblies is based on the principle of the kinetic recoil energy of the arm.

The solution suggested in said patent, while being one of the simplest solutions possible, requires, however, a certain complexity of manufacture due to the presence of a nib which maintains the arm locked by resting both against the locking bolt head and an abutment provided on the breech.

It is the object of the present invention to eliminate this disadvantage of the bolt assemblies disclosed in the Italian Pat. No. 762.319.

More particularly the bolt assembly for automatic firearms of the type comprising a locking bolt head and a floating bolt element with a spring interposed between them according to the invention is characterized in that the locking bolt head is rotatable and has a cylindrical portion with two radial crescent shaped diametrically opposite projections adapted to engage each an associated groove provided in the barrel and to disengage therefrom through two associated diametrically opposite recesses having a shape corresponding to that of the two crescent shaped projections of the locking bolt head; in that the floating bolt element engages by means of projecting edges guide grooves provided in the barrel; in that the locking bolt head has a shank which is narrowed with respect to the cylindrical portion provided with the crescent shaped projections and is received in a corresponding recess provided in the floating bolt element; and in that said shank engages by means of a pin projecting therefrom a helical slot provided in the floating bolt element.

The provision of a rotatable locking bolt assembly with a floating bolt element is a substantial improvement in the whole system inasmuch as it provides a bolt assembly consisting of only two elements (locking bolt head and floating bolt element) thus eliminating the nib and the abutment on the breech.

In addition, the bolt assembly according to the invention makes it possible to completely eliminate also the breech of the arm by providing the abutments for the locking of the arm by the rotatable locking bolt head on an extension of the barrel and housing the bolt assembly (rotatable locking bolt head and floating bolt element) inside the casing of the arm made of a light alloy, slidable on guides provided in the casing.

The rotatable locking bolt head is also per se a positive development of the prior art bolt assemblies both because of the simplicity of manufacture and, above all, the technical and operative advantages achieved due to the constructional features thereof.

The rotatable locking bolt head is in fact provided with only two crescent shaped projections which are diametrically opposite and oriented on the arm in the condition most favorable to limit at a minimum the back movement of the bolt during the opening of the arm and to leave the maximum resistance to the abutments for the locking bolt head provided on the extension of the barrel.

The wall forming said abutments has in fact discontinuities only at two recesses required for the passage of the projections of the locking bolt head and has therefore a high mechanical strength capable of withstanding the high pressures developed in the barrel at firing.

The angular position of the abutments on the arm for the locking bolt head is, in addition, such as to permit to extend beyond said abutments the opening for the ejection of the cartridge case thus reducing at a minimum the back movement of the floating bolt element.

The invention will be better understood from the following detailed description, given merely by way of example and therefore in no limiting sense, of an embodiment thereof as applied to a sporting gun all parts of which operating in a conventional manner are omitted, referring to the accompanying drawings in which.

Figure 1:
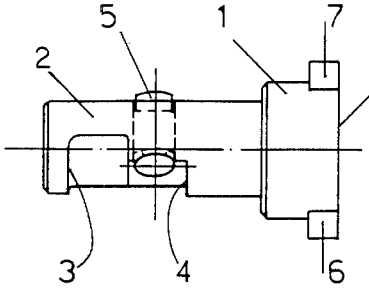
FIG. 1 is a side view of the rotatable locking bolt head in the position in which it is assembled on the arm.
Figure 5:
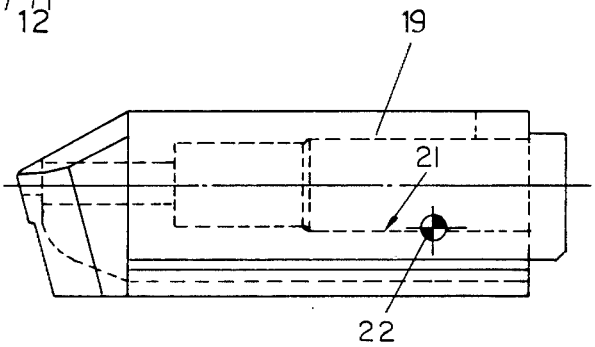
FIG. 5 is a side view of the floating bolt element in the position in which it is assembled on the arm.

From FIGS. 1 and 5 it is seen that the rotatable locking bolt head consists essentially of a cylindrical portion 1 which extends by means of a shank 2, which is received in a suitable seat recess 21 provided in the floating bolt element 19. A pin 22 carried by the floating bolt element 19 is adapted to engage two abutments 3 and 4 of the shank 2.

The shank 2 carries, in addition, a cylindrical pin 5 projecting from it and secured by means of a cement or held in position by the striker pin 31 (FIG. 7) of the arm, which pin 5 is adapted to impart a rotary movement to the locking bolt head by engaging a helical slot 20 (FIG. 6) provided on the floating bolt element 19.

Figure 2:
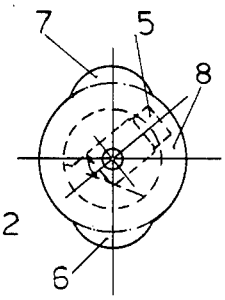
FIG. 2 is a front view of the same rotatable locking bolt head.

The rotatable locking bolt head carries, in addition, (FIG. 2) on its cylindrical portion 1 two diametrically opposite crescent shaped projections 6,7 which form with the front face of the cylindrical portion 1 a single front locking face 8.

Figure 3:
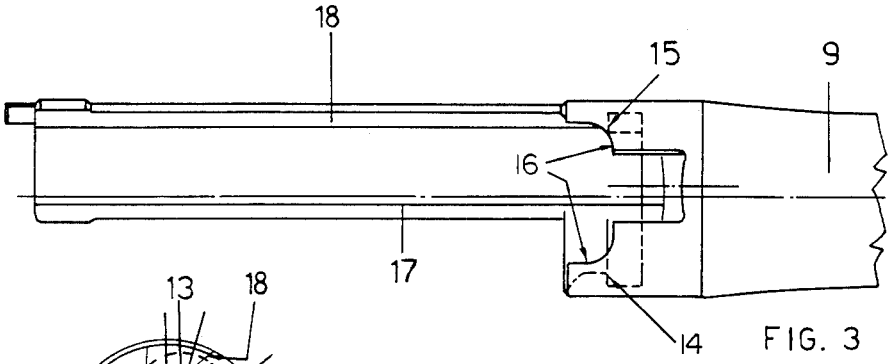
FIG. 3 is a side partial view of the barrel extension.
Figure 4:
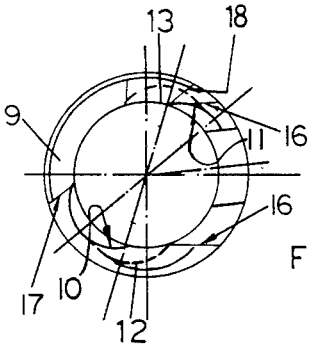
FIG. 4 is a front view of the same barrel extension.

From FIGS. 3 and 4 it can be noted that the barrel 9, shown only partially, has on its rear extension two diametrically opposite recesses 10,11 having a shape corresponding to that of the projections 6,7 of the cylindrical portion 1 of the rotatable locking bolt head, which recesses allow entry of the two projections 6,7 into associated grooves 12,13 which are also formed in the barrel 9, axially staggered with respect to the recesses 10,11 and having an angular extension substantially twice that of the recesses 10,11.

As seen from FIG. 3 the two grooves 12,13 in the barrel 9 provide abutments 14,15 for the projections 6,7 of the rotatable locking bolt head. Since the wall of the barrel forming said abutments has a discontinuity only at the two recesses 10,11 it has a high mechanical strength capable of withstanding any pressure developed inside the barrel.

Figure 9:
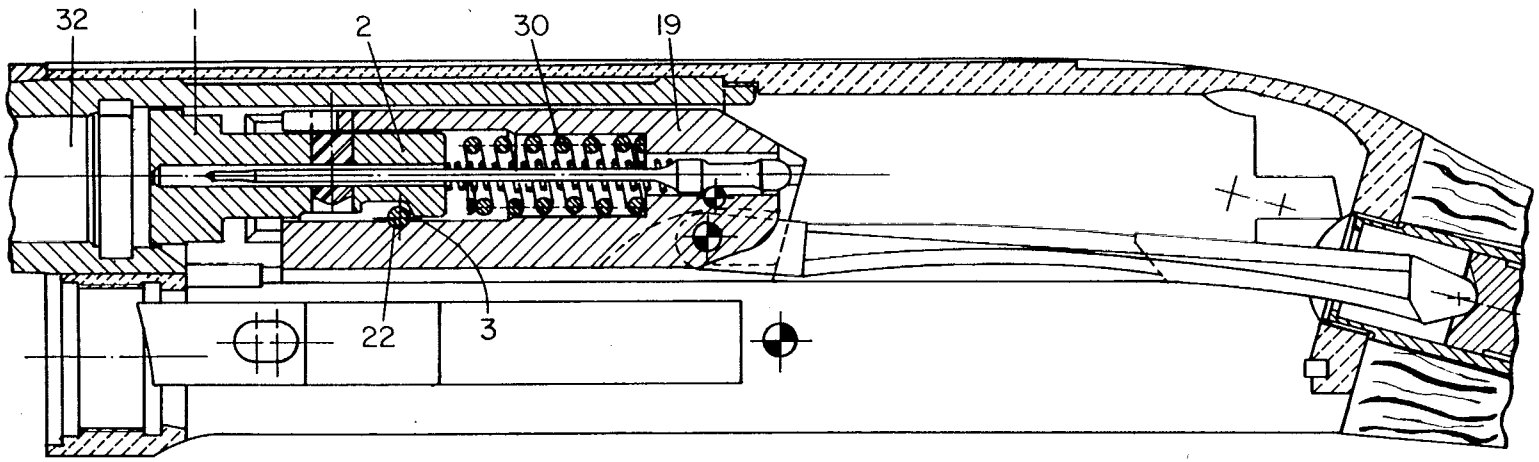
FIG. 9 is a fragmentary longitudinal cross-section of the arm with the rotatable locking bolt head in opened position at the beginning of its back movement.

The angular position of the two grooves 12,13 on the barrel 9 is such as to allow the provision of the opening 16 for the ejection of the cartridge cases very close to the cartridge chamber 32 (FIG. 9) of the arm and anyway in a position more advanced than the abutments 14,15.

In this way the provision of the rotatable locking bolt head in combination with the floating bolt element in a bolt assembly operating in an inertial mode does not increase the back movement at the opening of the arm for the ejection of the cartridge cases with respect to the prior art bolt assemblies.

The barrel 9 is cut in its rear position so as to form two inclined faces 17,18 forming the theoretical extension of the two recesses 10,11 for the passage of the projections 6,7 of the rotatable locking bolt head and preventing said head to rotate when the projections 6,7 are not at the associated grooves 12,13 provided on the barrel 9.

It can be finally noted (FIGS. 5 and 6) that the floating bolt element 19, to which the above described rotatable locking bolt head is applied, is provided with a helical slot 20 in which the cylindrical pin 5 projecting from the shank 2 of the rotatable locking bolt head (FIG. 1) is engaged.

Figure 6:
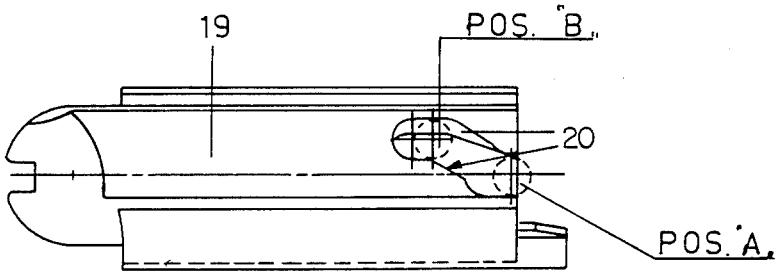
FIG. 6 is a top plan view of the same floating bolt element.
Figure 7:
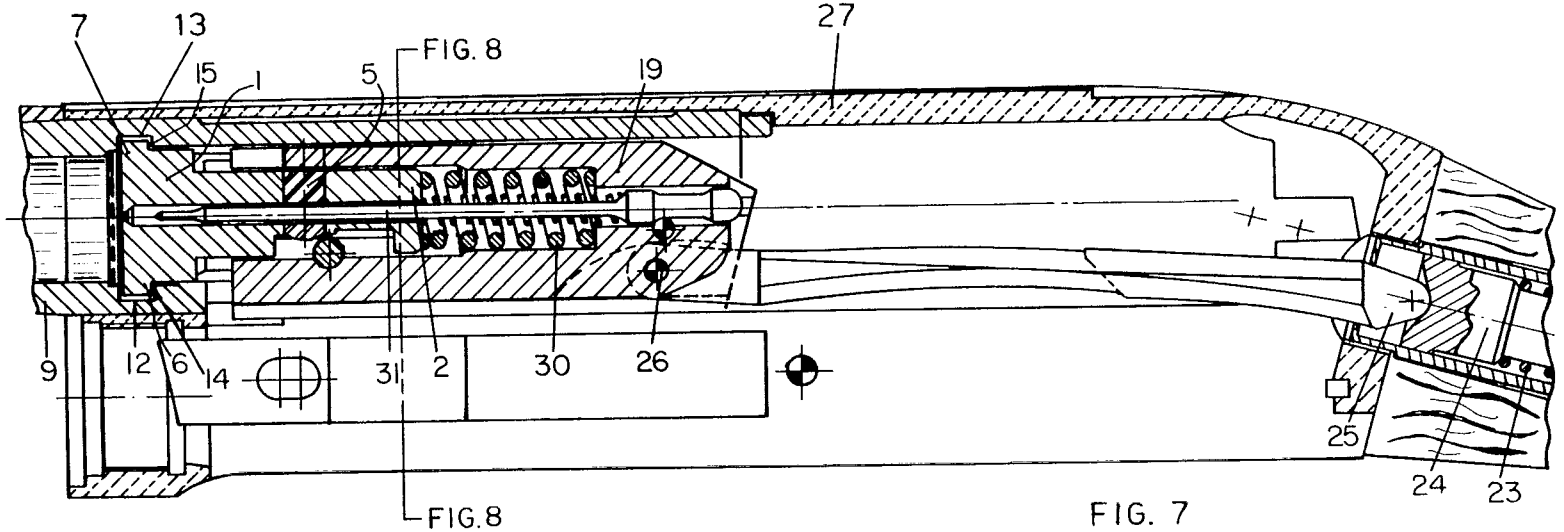
FIG. 7 is a fragmentary longitudinal cross-section of the arm with the rotatable locking bolt head in locked position.

This cylindrical pin 5 takes the position indicated by "A" in FIG. 6 when the whole bolt assembly (floating bolt element and locking bolt head) is in opened position and the position "B" when passing from the opened position to the locked position.

It is apparent that the transition of the pin from position "A" to position "B" involves a rotation of the locking bolt head since the floating bolt element is prevented from carrying out such a movement.

The floating bolt element 19 has a central bore 21 in which there is housed the shank 2 of the rotatable locking bolt head adapted to engage by its abutments 3 and 4 the stop pin 22 secured to the floating bolt element.

The above described bolt assembly of the rotatable locking bolt head and floating bolt element type uses for its operation the kinetic energy of the recoil of the arm and, as already stated, uses in a much more simple and affidable manner the same principle used in the Italian Pat. No. 762.319.

In the locked position (FIG. 7) the floating bolt element 19, by means of the return spring 23 acting on the spring guide pin 24 on which the end of a connecting rod 25 pivoted on the floating bolt element 19 by means of a pin 26 rests, keeps the cylindrical portion 1 of the locking bolt head with its two projections 6,7 rotated in the associated grooves 12,13 of the barrel 9 so as to rest against the associated abutments 14,15.

Under this condition the pressures developed in the barrel at firing are perfectly resisted by the abutments 14,15 provided on the barrel on which the two projections 6,7 provided on the cylindrical portion 1 of the rotatable locking bolt head rest.

The rotatable locking bolt head, in addition, cannot rotate to the opened position until the floating bolt element 19, at the beginning of its back movement, allows said rotation by means of the pin 5 projecting from the shank 2 of the locking bolt head, which pin engages the helical slot 20 provided on the floating bolt element 19 (FIG. 6).

Figure 8:
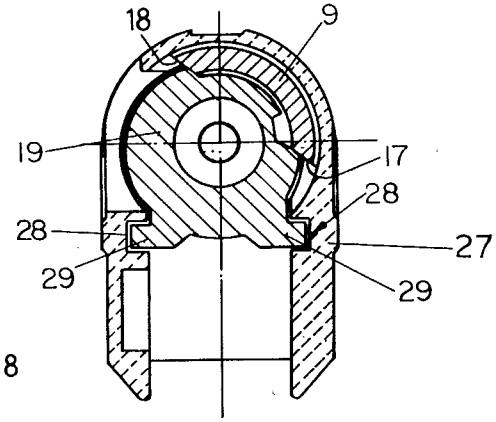
FIG. 8 is a fragmentary transverse cross-section of the same arm.

At firing the whole arm recoils against the operator of the firearm's shoulder but the floating bolt element 19, not bound to the casing 27 but only guided on its grooves 28 by means of the projecting edges 29 (FIG. 8), tends to keep its own position thus compressing the spring 30 interposed between the floating bolt element and the rear portion of the shank 2 of the rotatable locking bolt head.

During this step the pin 5 projecting from the shank 2 of the rotatable locking bolt head keeps (FIG. 6) in the position "B" sliding backwards on the parallel section of the helical slot provided on the floating bolt element.

The rotatable locking bolt head remains therefore in locked position along the whole compression time of the spring 30 thus generating a delay in the opening which is required in order that the pressures in the barrel drop to values which are no longer dangerous.

In fact, only when the recoil of the arm decreases to a predetermined value for which the spring 30 has been calibrated, the latter spreads out again and pushes, by means of the force stored during the compression step, the floating bolt element 19 back whereas at first the rotatable locking bolt head still remains in the barrel 9 in locked position.

It is in this step that the pin 5 projecting from the shank 2 of the rotatable locking bolt head moves (FIG. 6) from the position "B" to the position "A" and forces thereby the rotatable locking bolt head to disengage its projections 6,7 from the associated grooves 12,13 provided on the barrel, since the floating bolt element 19 is prevented from rotating (FIG. 8) by its projecting edges 29 always guided on the grooves 28 of the casing 27.

At this time (FIG. 9) also the rotatable locking bolt head, by now connected to the floating bolt element 19 by the contact of the stop pin 22 with the abutment 3 of its shank 2, is free to move back under the action of the push imparted to the floating bolt element by the spring 30.

Therefore, the whole bolt assembly (floating bolt element and rotatable locking bolt head) moves from the locked position to the final opened position, not shown, causing, in a conventional manner, the extraction of the cartridge case from the cartridge chamber of the arm, its ejection and the reloading of the arm.

There is thus provided a bolt assembly of a rotating locking bolt head and floating bolt element type with wholly peculiar features, capable of standing the maximum pressures in the barrel because of the particular constructional shape of the two projections alone provided on the rotatable locking bolt head and the associated grooves provided in the barrel so as not to increase the back opening movement of the arm and with a substantial reduction of the manufacturing cost.

While but one embodiment of the invention has been described and illustrated, it is obvious that a number of changes and modification can be made without departing from the spirit and scope of the invention.

I claim:

1. A bolt assembly for an automatic firearm which operates in an inertial mode using kinetic recoil energy comprising a barrel, a floating bolt element formed with a helical slot, a rotatable locking bolt head, a return spring interposed between the rotatable locking bolt head and the floating bolt element; the spring, rotatable locking bolt head and the floating bolt element in communication with the barrel, the rotatable locking bolt head formed with a cylindrical portion having two crescent shaped projections located at diametrically opposite points along the circumference of the cylindrical portion, the barrel formed with two diametrically opposite recesses associated with and shaped to correspond to the crescent shaped projections, a pair of grooves formed in the barrel, each groove associated with a recess such that the crescent shaped projections may enter and exit the grooves through the recesses, the grooves being staggered with respect to the recesses and having an angular extension such that the crescent shaped projections may enter and be retained within the grooves, the barrel formed with projecting edge guide grooves, the floating bolt element formed with projecting edges that are located in and guided by the projecting edge guide grooves, the locking bolt head including a shank having a lesser diameter than that of the cylindrical portion of the locking bolt head, a cavity formed in the floating bolt element for receiving the shank, the shank carrying a pin adapted to impart a rotary movement to the locking bolt head by engaging the helical slot formed in the floating bolt element, whereby the firearm is in a locked position when the crescent shaped projections of the cylindrical portion of the locking bolt head are retained within the associated grooves formed in the barrel by means of the return spring, whereby upon firing the firearm recoils, the floating bolt element maintains its position by means of the projecting edge guide grooves sliding over the projecting edges of the floating bolt element thereby compressing the return spring, the rotatable locking bolt head remaining in a locked position during compression of the return spring to provide a delay which permits the dissipation of pressures in the barrel after firing, the return spring upon being compressed to a predetermined level expands and exerts a force upon the floating bolt element causing the helical slot of the floating bolt element to impart a rotary movement to the rotatable locking bolt head through the pin carried by the shank, which causes the rotatable locking bolt head to disengage its projections from the associated grooves formed in the barrel causing the crescent shaped projections of the cylindrical portion of the rotatable locking bolt head to pass through the recesses formed in the barrel to put the firearm in an unlocked position to permit reloading.

2. A bolt assembly as claimed in claim 1 wherein the shank of the rotatable locking bolt head includes a recess forming two abutments adapted to engage a cross pin carried by the floating bolt element to limit the relative axial movement between the rotatable locking bolt head and the floating bolt element.

* * * * *